US011232747B2

(12) United States Patent
Li et al.

(10) Patent No.: US 11,232,747 B2
(45) Date of Patent: Jan. 25, 2022

(54) DISPLAY PANEL AND DRIVING METHOD THEREOF, AND DISPLAY APPARATUS

(71) Applicants: Hefei Xinsheng Optoelectronics Technology Co., Ltd., Hefei (CN); BOE Technology Group Co., Ltd., Beijing (CN)

(72) Inventors: Meng Li, Beijing (CN); Min He, Beijing (CN); Zhidong Yuan, Beijing (CN); Can Yuan, Beijing (CN); Haixia Xu, Beijing (CN)

(73) Assignees: Hefei Xinsheng Optoelectronics Technology Co., Ltd, Hefei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/982,024

(22) PCT Filed: Apr. 2, 2020

(86) PCT No.: PCT/CN2020/083052
§ 371 (c)(1),
(2) Date: Sep. 17, 2020

(87) PCT Pub. No.: WO2020/233248
PCT Pub. Date: Nov. 26, 2020

(65) Prior Publication Data

US 2021/0193035 A1 Jun. 24, 2021

(30) Foreign Application Priority Data

May 23, 2019 (CN) ..... 201910434686.8

(51) Int. Cl.
*G09G 3/3233* (2016.01)
*G09G 3/3208* (2016.01)

(52) U.S. Cl.
CPC ... *G09G 3/3233* (2013.01); *G09G 2300/0452* (2013.01); *G09G 2310/0251* (2013.01);
(Continued)

(58) Field of Classification Search
CPC ..... G09G 2320/0233; G09G 2320/045; G09G 2320/043; G09G 2320/0295
See application file for complete search history.

(56) References Cited

U.S. PATENT DOCUMENTS 10,276,096 B2 * 4/2019 Li ..... G09G 3/3233
2014/0022289 A1 * 1/2014 Lee ..... G09G 3/006 345/691

(Continued)

FOREIGN PATENT DOCUMENTS

CN 202886797 U 4/2013
CN 103578411 A 2/2014

(Continued)

OTHER PUBLICATIONS

CN201910434686.8 OA1.
CN201910434686.8 OA2.

*Primary Examiner* — Sepehr Azari
(74) *Attorney, Agent, or Firm* — IPRO, PLLC

(57) ABSTRACT

The present disclosure provides a display panel and a driving method thereof, and a display apparatus. The display panel includes: a plurality of sub-pixels arranged in an array, a plurality of data lines, and a plurality of compensation detection lines, wherein each data line is coupled with sub-pixels in one column; sub-pixels in every three columns serve as one first sub-pixel group, and each first sub-pixel group corresponds to two compensation detection lines which include a first detection line and a second detection line; and in each first sub-pixel group, sub-pixels in the first column are coupled with the first detection line, sub-pixels in the third column are coupled with the second detection (Continued)

line, and sub-pixels in the second column are alternatively coupled with the first detection line and the second detection line.

15 Claims, 5 Drawing Sheets

(52) U.S. Cl.
CPC ..... *G09G 2320/0233* (2013.01); *G09G 2320/0252* (2013.01); *G09G 2320/045* (2013.01)

(56) References Cited

U.S. PATENT DOCUMENTS

| | | | | |
|---|---|---|---|---|
| 2017/0092190 | A1 | 3/2017 | Choe | |
| 2017/0170200 | A1* | 6/2017 | Ikeda | G09G 3/3233 |
| 2018/0151129 | A1 | 5/2018 | Park | |
| 2018/0197466 | A1 | 7/2018 | Roh | |
| 2018/0308430 | A1 | 10/2018 | Xu | |
| 2018/0330666 | A1* | 11/2018 | Song | H01L 27/1214 |
| 2019/0035334 | A1 | 1/2019 | Lin et al. | |
| 2019/0066590 | A1* | 2/2019 | Li | G09G 3/3258 |
| 2019/0066591 | A1 | 2/2019 | Xu et al. | |
| 2019/0371245 | A1* | 12/2019 | Yuan | G09G 3/3233 |
| 2020/0152126 | A1* | 5/2020 | Jo | G09G 3/3258 |
| 2020/0202786 | A1 | 6/2020 | Li et al. | |

FOREIGN PATENT DOCUMENTS

| | | | |
|---|---|---|---|
| CN | 104112423 | A | 10/2014 |
| CN | 206322697 | U | 7/2017 |
| CN | 107016964 | A | 8/2017 |
| CN | 107086023 | A | 8/2017 |
| CN | 107393469 | A | 11/2017 |
| CN | 107452333 | A | 12/2017 |
| CN | 108877651 | A | 11/2018 |
| CN | 109166529 | A | 1/2019 |
| CN | 109523954 | A | 3/2019 |
| CN | 110060633 | A | 7/2019 |
| KR | 20090043301 | A | 5/2009 |

* cited by examiner

DISPLAY PANEL AND DRIVING METHOD THEREOF, AND DISPLAY APPARATUS

CROSS REFERENCE TO RELATED APPLICATIONS

The present disclosure is a National Stage of International Application No. PCT/CN2020/083052, filed on Apr. 2, 2020, which claims priority of the Chinese Patent Application No. 201910434686.8 filed to the China National Intellectual Property Administration on May 23, 2019, and entitled "DISPLAY PANEL AND DRIVING METHOD THEREOF, AND DISPLAY APPARATUS", both of which are hereby incorporated by reference in their entireties.

FIELD

The present disclosure relates to the field of display technology, and more particularly, to a display panel and a driving method thereof, and a display apparatus.

BACKGROUND

An Organic Light Emitting Diode (OLED) display has the advantages of light self-emission, low energy consumption and the like, and is one of hot spots in the field of application research of a display panel at present.

Currently, the OLED display generally belongs to a current driven type, a stable current is required for driving the OLED display to emit light, and in the OLED display, a pixel circuit is adopted to drive OLEDs to emit light. However, as service time is increased, a drive transistor in the pixel circuit may generate cases of aging and the like, resulting in drift of a threshold voltage and mobility of the drive transistor, so that a display brightness difference can be caused.

SUMMARY

An embodiment of the present disclosure provides a display panel, including:

a plurality of sub-pixels in an array, wherein sub-pixels in every three columns of the array serve as one of first sub-pixel groups;

a plurality of data lines, wherein a respective one of the plurality of data lines is coupled with sub-pixels in a respective one column of the array; and a plurality of compensation detection lines, wherein each of the first sub-pixel groups corresponds to two of the compensation detection lines, and the two of the compensation detection lines include a first detection line and a second detection line; and in each of the first sub-pixel groups, sub-pixels in a first column of the every three columns are coupled with the first detection line, sub-pixels in a third column of the every three columns are coupled with the second detection line, and sub-pixels in a second column of the every three columns are alternatively coupled with the first detection line and the second detection line.

In a possible implementation, in the display panel provided by the embodiment of the present disclosure, two adjacent sub-pixels in a column of the array are staggered in a column direction by X sub-pixels; and $0<X<1$.

In a possible implementation, in the display panel provided by the embodiment of the present disclosure, sub-pixels in each column of the array include sub-pixels in two colors, and the sub-pixels in two colors are alternatively arranged; and sub-pixels in each row of the array include sub-pixels in three colors, and sub-pixels in each color of the three colors are periodically and repeatedly arranged in the row.

In a possible implementation, the display panel provided by the embodiment of the present disclosure further includes: a plurality of first gate lines and a plurality of second gate lines;

wherein each of the plurality of sub-pixels includes a switching transistor and a detection transistor, an input terminal of the switching transistor is coupled with the data line, and an output terminal of the detection transistor is coupled with one of the plurality of compensation detection line; and for sub-pixels in each row of the array, a control terminal of the detection transistor in each of the sub-pixels in the row of the array is coupled with one of the plurality of first gate lines, and a control terminal of the switching transistor in each of the sub-pixels in the row of the array is coupled with one of the plurality of second gate line.

In a possible implementation, in the display panel provided by the embodiment of the present disclosure, each of the plurality of sub-pixels further includes a drive transistor and a storage capacitor;

an input terminal of the drive transistor is coupled with a high-voltage power signal line, an output terminal of the drive transistor is coupled with an output terminal of a light emitting device and an input terminal of the detection transistor, and a control terminal of the drive transistor is coupled with an output terminal of the switching transistor; and the storage capacitor is coupled between the control terminal of and the output terminal of the drive transistor.

In a possible implementation, in the display panel provided by the embodiment of the present disclosure, the first gate line and the second gate line which are coupled with the sub-pixels in a same row of the array are positioned in a same row gap.

In a possible implementation, in the display panel provided by the embodiment of the present disclosure, sub-pixels in every two rows of the array serve as one second pixel group; and the first gate line and the second gate line which correspond to a same second pixel group are both positioned in a row gap in the second pixel group.

An embodiment of the present disclosure further provides a driving method of the above-mentioned display panel, including:

in a compensation time period, for each first sub-pixel group, when compensation detection is carried out each time, selecting, from sub-pixels in two adjacent rows of the array, one sub-pixel coupled with the first detection line and one sub-pixel coupled with the second detection line as to-be-compensated sub-pixels;

controlling each of the to-be-compensated sub-pixels to charge the compensation detection line coupled with each of the to-be-compensated sub-pixels; and detecting an output voltage of the compensation detection line coupled with each of the to-be-compensated sub-pixels, and determining a compensation voltage of the to-be-compensated sub-pixels according to the output voltage.

In a possible implementation, in the driving method provided by the embodiment of the present disclosure, when compensation detection is carried out at a time, the two to-be-compensated sub-pixels selected from sub-pixels in two adjacent rows of the array are positioned on the same row.

In a possible implementation, in the driving method provided by the embodiment of the present disclosure, when compensation detection is carried out at a time, the two to-be-compensated sub-pixels selected from sub-pixels in two adjacent rows of the array are positioned on the same column.

In a possible implementation, in the driving method provided by the embodiment of the present disclosure, the controlling each of the to-be-compensated sub-pixels to charge the compensation detection line coupled with each of the to-be-compensated sub-pixels specifically includes: inputting synchronously turned-on signals to respective first gate lines and respective second gate lines which are coupled with to-be-compensated sub-pixels in respective row, respectively, and inputting data voltages to the plurality of data lines coupled with the to-be-compensated sub-pixels.

In a possible implementation, in the driving method provided by the embodiment of the present disclosure, when data voltages of different sub-pixels are sequentially input to the same data line, setting low-level between the data voltages.

An embodiment of the present disclosure further provides a display apparatus, including: the display panel provided by the embodiment of the present disclosure.

DETAILED DESCRIPTION OF THE EMBODIMENTS

In order to ensure display quality, a threshold voltage and mobility of a drive transistor in a pixel circuit can be compensated in an external compensating manner. However, in the related art, when pixels in an OLED display are detected and compensated, the pixels need to be detected row by row, and a detection speed is low, resulting in relatively short display time of the OLED display, and normal display of the OLED display is influenced.

Figure 1:
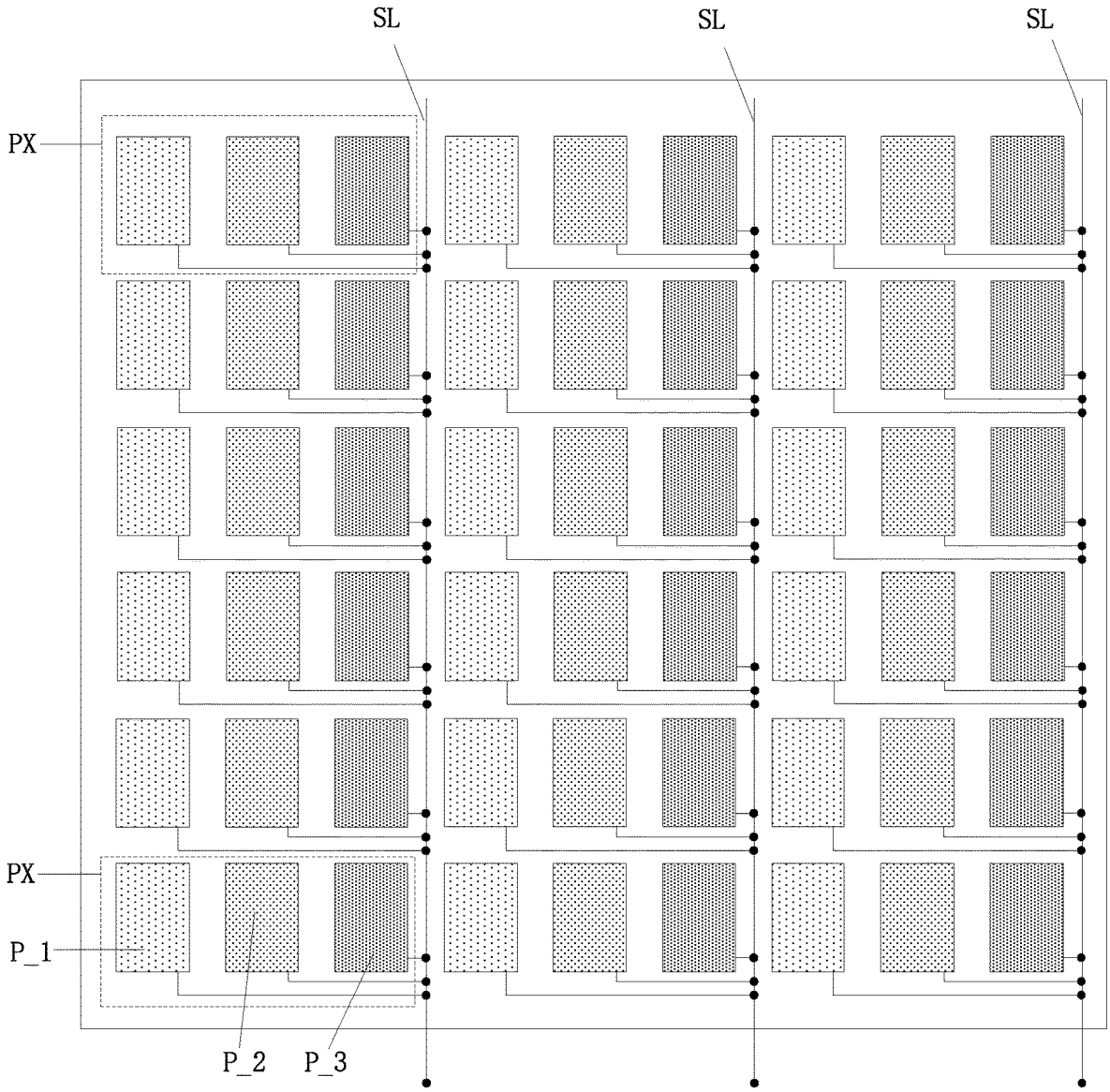
FIG. 1 is a schematic diagram of a connection relationship of compensation detection lines of a display panel in the related art.

As shown in FIG. 1, in the related art, each pixel PX is coupled with one compensation detection line SL, and each compensation detection line SL is coupled with one column of pixels PX. For example, in FIG. 1, each pixel PX includes three sub-pixels P_1, P_2 and P_3 which generally are three red (R), green (G) and blue (B) sub-pixels, and three sub-pixels P_1, P_2 and P_3 in each pixel PX are coupled with the same compensation detection line SL. When each sub-pixel is detected and compensated, the sub-pixels are detected row by row, and only one sub-pixel in each pixel PX can be detected each time, so that each row of pixels need to be detected for three times. FIG. 1 just takes a case that each pixel includes three sub-pixels as an example, and in the specific implementation, each pixel may also include four red (R), green (G), blue (B) and white (W) sub-pixels or more sub-pixels, so that pixels in each row need to be detected for four or more times.

Based on this, for the problem that in the related art, due to low pixel detection speed in the OLED display, normal display of the OLED display is influenced, embodiments of the present disclosure provide a display panel and a driving method thereof, and a display apparatus.

Specific embodiments of the display panel and the driving method thereof and the display apparatus, as provided by the embodiments of the present disclosure, will be illustrated in detail below in combination of the drawings. The size and shape of each structure in the drawings do not reflect a true scale, but just aim to schematically illustrate the contents of the present disclosure.

Figure 2:
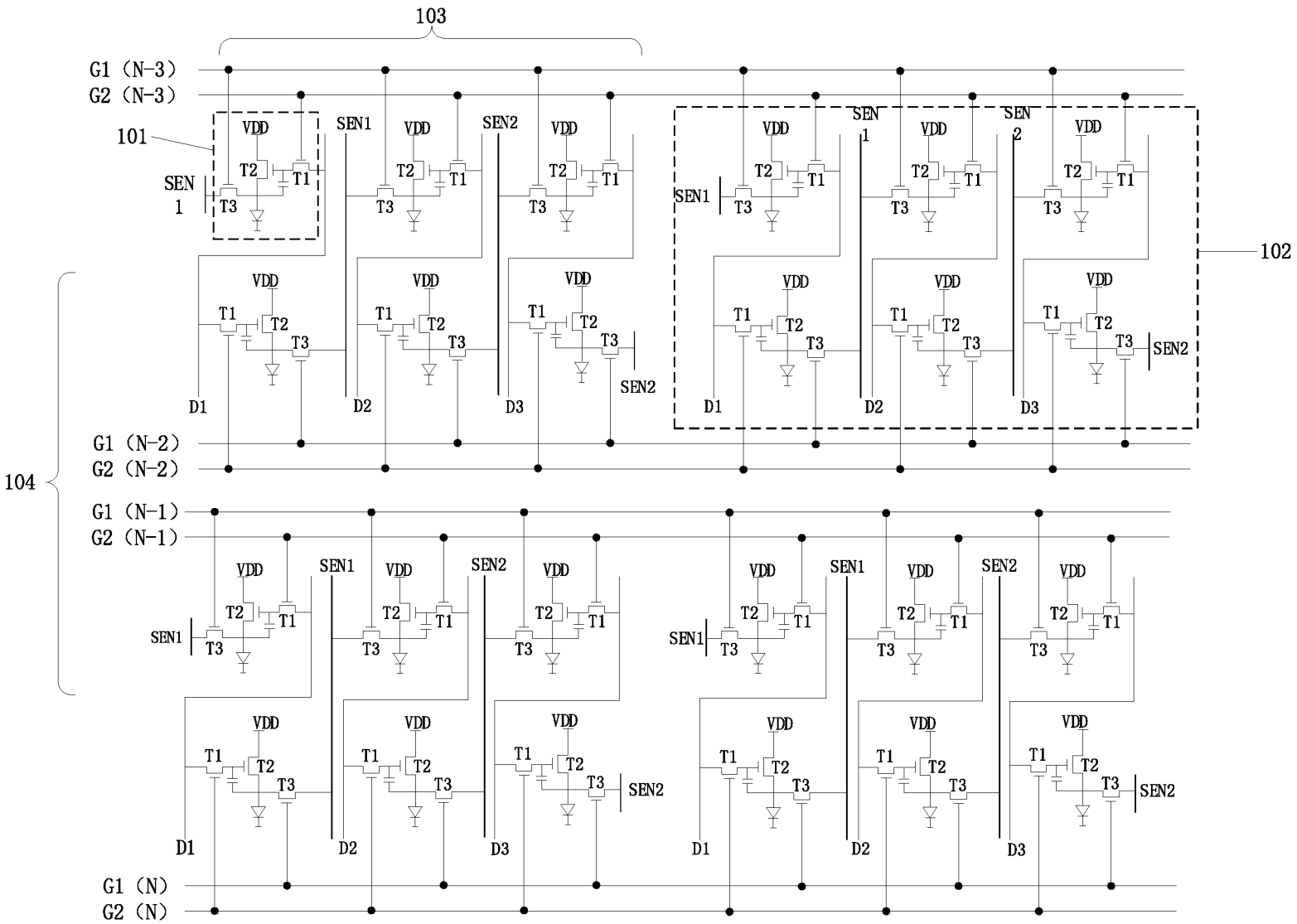
FIG. 2 is a structural schematic diagram of a display panel provided by an embodiment of the present disclosure.

An embodiment of the present disclosure provides a display panel. As shown in FIG. 2, the display panel may include: a plurality of sub-pixels 101 arranged in an array, a plurality of data lines (such as D1, D2 and D3 in FIG. 2), and a plurality of compensation detection lines (such as SEN1 and SEN2 in FIG. 2), wherein:

each data line is coupled with one column of sub-pixels 101;

sub-pixels 101 in every three columns serve as one first sub-pixel group 103, and each first sub-pixel group 103 corresponds to two compensation detection lines which include a first detection line SEN1 and a second detection line SEN2; and in each first sub-pixel group 103, sub-pixels 101 in a first column are coupled with the first detection line SEN1, sub-pixels 101 in a third column are coupled with the second detection line SEN2, and sub-pixels 101 in a second column are alternatively coupled with the first detection line SEN1 and the second detection line SEN2.

Specifically, in the display panel provided by the embodiment of the present disclosure, each first sub-pixel group corresponds to two compensation detection lines, wherein the sub-pixels in the first column are coupled with the first detection line, the sub-pixels in the third column are coupled with the second detection line, and the sub-pixels in the second column are alternatively coupled with the first detection line and the second detection line, so that in the detection compensation process, for each first sub-pixel group, two sub-pixels coupled with different compensation detection lines may be selected from sub-pixels in two adjacent rows to be compensated together, and thus, in the first sub-pixel group, sub-pixels in every two rows only need to be detected for three times, and a detection speed is increased to a great degree, thereby making display time relatively long and improving a display effect.

It should be noted that in the drawing, each signal line is represented with at least two line segments just for more clearly indicating a connection relationship between the signal line and each sub-pixel, but in the practical application, in each first sub-pixel group 103 in FIG. 2, the signal lines with the same reference sign are the same signal line, for example, each data line D1 belonging to the same column is in a coupled relationship, each first detection line SEN1 is in a coupled relationship, and each second detection line SEN2 is in a coupled relationship.

In addition, in each accompanying drawing in the embodiments of the present disclosure, indication is carried out by taking a limited number of sub-pixels as an example, but in the specific implementation, the display panel may include more sub-pixels, and the number of the sub-pixels included in the display panel is not limited herein.

Figure 3:
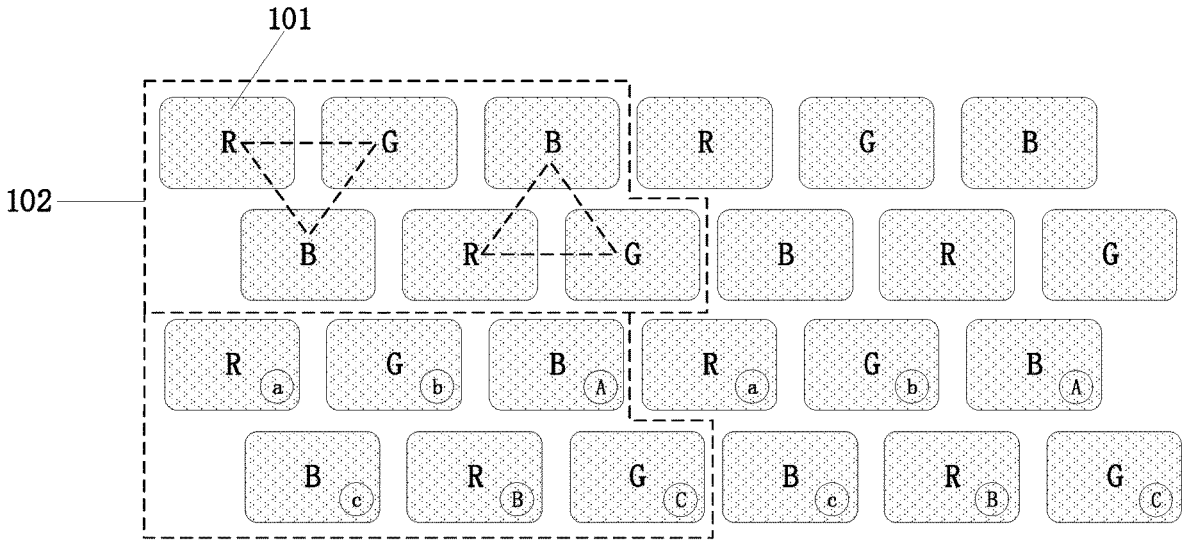
FIG. 3 is a schematic diagram of arrangement of sub-pixels in the embodiment of the present disclosure.

FIG. 3 is a schematic diagram of arrangement of the sub-pixels in the display panel provided by the embodiment of the present disclosure, and in combination of FIG. 2 and FIG. 3, in the specific implementation, sub-pixels in two rows and three columns in the drawings serve as one pixel unit 102, and the sub-pixels 101 in the display panel are arranged by taking the pixel unit 102 as a repeat unit. By taking sub-pixels in the third and fourth rows in the drawings as an example, in the first detection process, each sub-pixel a and each sub-pixel A may be selected to be compensated, each sub-pixel a is coupled with the corresponding first detection line SEN1, and each sub-pixel A is coupled with the corresponding second detection line SEN2, i.e., the sub-pixel a and the sub-pixel A are coupled with different compensation detection lines, and thus, the sub-pixel a and the sub-pixel A can be compensated together. Similarly, in the second detection process, each sub-pixel c and each sub-pixel C may be selected to be compensated, and in the third detection process, each sub-pixel b and each sub-pixel B may be selected to be compensated. Therefore, in the display panel in the embodiment of the present disclosure, sub-pixels in every two rows only need to be detected for three times, and compared to the display panel in FIG. 1, the display panel in the embodiment of the present disclosure is improved at least twice in the aspect of the detection speed.

In the practical application, in the display process of the display panel, scanning is generally started from the top left corner of an image and is advanced forwards horizontally, and simultaneously, a scanning spot also moves down at a low speed; after a frame of complete image is scanned, scanning of a new frame of image is started; a scanning time interval between two adjacent frames can be referred to as a vertical blanking interval or blanking area; data transmission of the displayed image is not carried out in the vertical blanking interval, and thus signal detection can be carried out in this time period; in the embodiment of the present disclosure, the detection compensation process for each sub-pixel can be carried out in the blanking area; and due to shortening of compensation time, time for display can be relatively long, so as to avoid bad influence of long detection time on the displayed image and improve the display effect.

Specifically, in the display panel provided by the embodiment of the present disclosure, as shown in FIG. 3, two adjacent sub-pixels 101 in a column are staggered in the column direction by X sub-pixels 101; and $0<X<1$. For example, in the drawing, a first sub-pixel 101 in the second row is roughly retracted by a distance of half of one sub-pixel relative to a first sub-pixel 101 in the first row, so that a line arrangement space of the display panel can be more reasonably utilized, and the sub-pixels in the display panel are more compact. In addition, by taking one pixel unit 102 on the top left corner in FIG. 3 as an example, precisely because sub-pixels in two adjacent rows are staggered mutually, the pixel unit 102 can display according to two pixels in which the sub-pixels are arranged like a tripod, e.g., two pixels defined by two triangles in the drawing, so that the sub-pixels in each pixel can be further gathered, different colors of light rays emerging from three sub-pixels are easier to mix into a light ray having a desired color, and the display effect is better.

In the specific implementation, in the display panel provided by the embodiment of the present disclosure, as shown in FIG. 3, sub-pixels 101 in each column include sub-pixels 101 in two colors, and the sub-pixels 101 in two colors are alternatively arranged; sub-pixels 101 in each row include sub-pixels 101 in three colors, and the sub-pixels in each color are periodically and repeatedly arranged.

As shown in FIG. 3, in sub-pixels 101 in the first column, red (R) sub-pixels 101 and blue (B) sub-pixels 101 are alternatively arranged, in sub-pixels 101 in the second column, green (G) sub-pixels 101 and the red sub-pixels are alternatively arranged, and in sub-pixels 101 in the third column, the blue sub-pixels and the green sub-pixels are alternatively arranged. Moreover, in each row, sub-pixels in three colors, i.e., the red, green and blue sub-pixels, are sequentially, periodically and repeatedly arranged, and thus constitute a structure in which a plurality of pixel units 102 are repeatedly arranged, so that the display panel can display according to a case that the sub-pixels that are arranged like a tripod, defined by a triangle in the drawing constitute one pixel, or can display according to a case that three adjacent sub-pixels in each row serve as one pixel. FIG. 3 only takes one case as an example for indication, and in the specific implementation, the color of each sub-pixel may also be adjusted according to actual demands, and is not limited herein.

Further, the display panel provided by the embodiment of the present disclosure, as shown in FIG. 2, may further include: a plurality of first gate lines G1 and a plurality of second gate lines G2;

each sub-pixel 101 includes a switching transistor T1 and a detection transistor T3, the input terminal of the switching transistor T1 is coupled with the data line D, and the output terminal of the detection transistor T3 is coupled with the compensation detection line SEN; and for sub-pixels 101 in each row, the control terminal of each detection transistor T3 is coupled with the first gate line G1, and the control terminal of each switching transistor T1 is coupled with the second gate line G2.

In the specific implementation, the first gate line G1 may control the detection transistors T3 of sub-pixels 101 in one row to be turned on and off, and the second gate line G2 may control the switching transistors T1 of sub-pixels 101 in one row to be turned on and off.

In addition, the display panel may further include a drive transistor T2 and a storage capacitor, the input terminal of the drive transistor T2 is coupled with a high-voltage power line VDD, the output terminal of the drive transistor T2 is coupled with an output terminal of a light emitting device, the control terminal of the drive transistor T2 is coupled with the output terminal of the switching transistor T1 and coupled with one terminal of the storage capacitor, and the other terminal of the storage capacitor is coupled with the input terminal of the detection transistor T3.

In the display process, the switching transistor T1 is controlled to be on by the second gate line G2 so as to write a data voltage in the data line into a gate electrode of the drive transistor T2, thereby controlling the drive transistor T2 to generate a working current to drive the light emitting device to emit light. In the process of carrying out detection compensation on the sub-pixel, the detection transistor T3 is controlled to be on by the first gate line G1 so as to control a pixel circuit in the sub-pixel to charge the compensation detection line, and then according to a voltage output by each compensation detection line, a corresponding compensation voltage of the sub-pixel may be obtained so as to obtain a data voltage of the sub-pixel, which is used for display.

Specifically, in the display panel provided by the embodiment of the present disclosure, as shown in FIG. 2, the first gate line G1 and the second gate line G2 which are coupled with sub-pixels 101 in the same row are positioned in the same row gap. For example, the first gate line G1(N−3) and the second gate line G2(N−3) which are coupled with the sub-pixels 101 in the first row are both positioned on the upper side of the sub-pixels 101 in the first row, and the first gate line G1(N−2) and the second gate line G2(N−2) which are coupled with the sub-pixels 101 in the second row are both positioned between the sub-pixels 101 in the second row and the sub-pixels 101 in the third row. Therefore, a space of the display panel can be more reasonably utilized, so that the display panel implements high-resolution display more easily.

In the specific implementation, in the display panel provided by the embodiment of the present disclosure, as shown in FIG. 2, sub-pixels 101 in every two rows serve as one second pixel group 104; and each first gate line G1 and each second gate line G2 which correspond to the same second pixel group 104 are both positioned in a row gap in the second pixel group 104.

In other words, each first gate line G1 and each second gate line G2 which correspond to the second pixel group 104 are both arranged in the same row gap so as to make arrangement of the gate lines more centralized and benefit layout line arrangement, thereby making the signal lines in the display panel more compact and enabling the display panel to implement high-resolution display more easily.

On the basis of the same inventive concept, an embodiment of the present disclosure further provides a driving method of the display panel. The principle of solving the problem of the driving method is similar to that of the display panel, and thus, implementation of the driving method can refer to implementation of the display panel, and will not be repeated herein.

Figure 4:
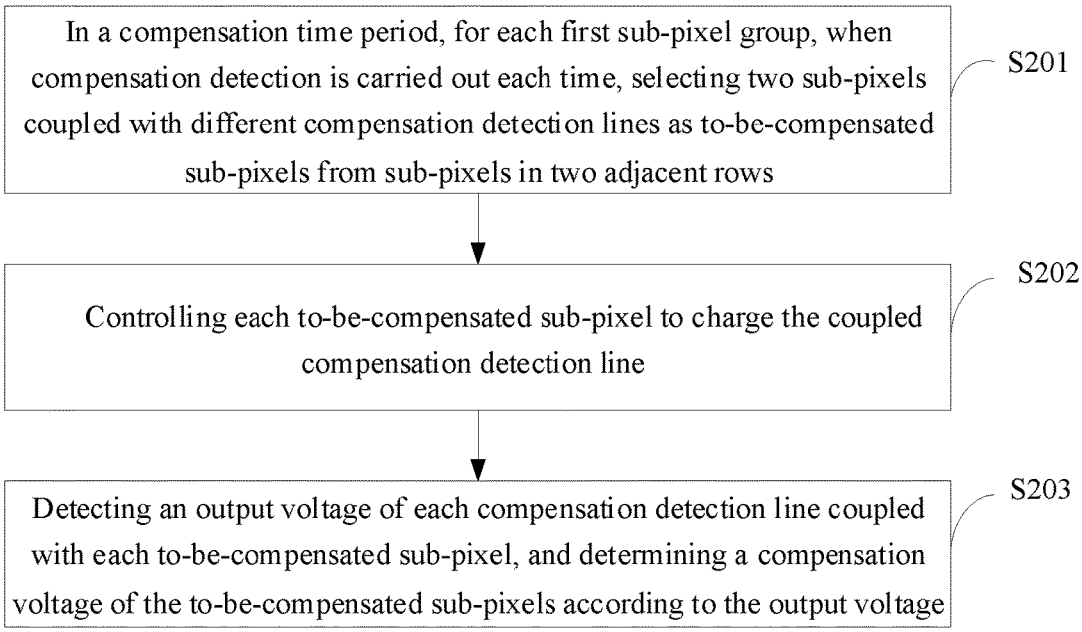
FIG. 4 is a flow chart of a driving method of a display panel, as provided by an embodiment of the present disclosure.

The driving method of the display panel, which is provided by the embodiment of the present disclosure, as shown in FIG. 4, includes:

step S201: in a compensation time period, for each first sub-pixel group, when compensation detection is carried out each time, two sub-pixels coupled with different compensation detection lines are selected as to-be-compensated sub-pixels from sub-pixels in two adjacent rows;

step S202: each to-be-compensated sub-pixel is controlled to charge the coupled compensation detection line; and step S203: an output voltage of each compensation detection line coupled with each to-be-compensated sub-pixel is detected, and a compensation voltage of the to-be-compensated sub-pixels is determined according to the output voltage.

According to the driving method of the display panel, as provided by the embodiment of the present disclosure, in the detection compensation process, for each first sub-pixel group, two sub-pixels coupled with different compensation detection lines can be selected from the sub-pixels in two adjacent rows to be detected together, and thus, the sub-pixels in every two rows need to be detected for three times, and a detection speed is increased to a great degree, so that display time is relatively long, and a display effect is improved.

Specifically, in the driving method provided by the embodiment of the present disclosure, in combination of FIG. 2 and FIG. 3, when compensation detection is carried out at a time, two to-be-compensated sub-pixels selected from sub-pixels 101 in two adjacent rows are in the same row; for example, the sub-pixel a and the sub-pixel A in FIG. 3 are selected as the to-be-compensated sub-pixels.

The step S202 may include: turned-on signals are input to a first gate line G1 and a second gate line G2 which correspond to a row where the to-be-compensated sub-pixel is positioned, respectively, and a data voltage is input to a data line coupled with the to-be-compensated sub-pixel. With reference to FIG. 2, the sub-pixel a and the sub-pixel A are in the same row, the first gate line and the second gate line correspond to the row where the sub-pixel a is positioned are G1(N−1) and G2(N−1), respectively, the turned-on signals may be input to the first gate line G1(N−1) and the second gate line G2(N−1), respectively, and the data voltages may be input to the data lines D1 and D3.

Specifically, in the driving method provided by the embodiment of the present disclosure, in combination of FIG. 2 and FIG. 3, when compensation detection is carried out at a time, two to-be-compensated sub-pixels selected from the sub-pixels 101 in two adjacent rows are in the same column; for example, the sub-pixel b and a sub-pixel B in FIG. 3 are selected as the to-be-compensated sub-pixels.

The step S202 may include: turned-on signals are input to each first gate line and each second gate line which correspond to a row where each to-be-compensated sub-pixel is positioned, respectively, and a data voltage is input to a data line coupled with the to-be-compensated sub-pixel.

With reference to FIG. 2, the first gate line and the second gate line which correspond to the sub-pixel b are G1(N−1) and G2(N−1), respectively, the first gate line and the second gate line which correspond to the sub-pixel B are G1(N) and G2(N), respectively, the turned-on signals may be input to the first gate lines G1(N−1) and G1(N) and the second gate lines G2(N−1) and G2(N), respectively, and the data voltages may be input to the data line D2.

Figure 5:
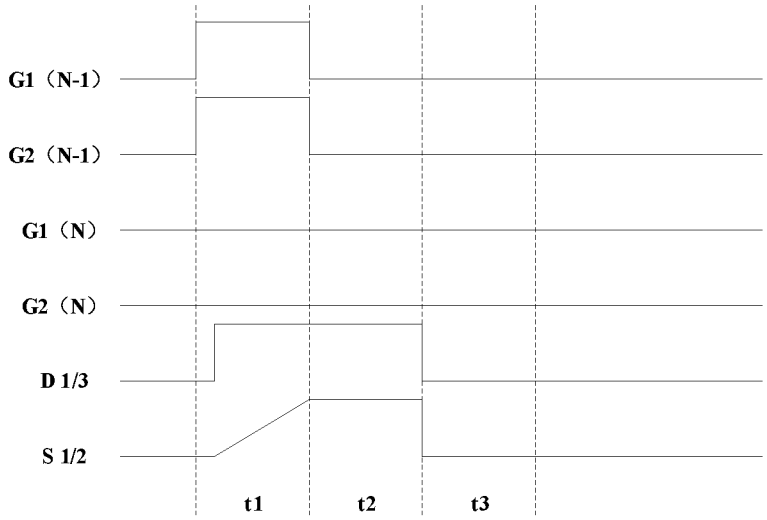
FIG. 5 to FIG. 7 are schematic timing diagrams in the compensating process in embodiments of the present disclosure, respectively.
Figure 6:
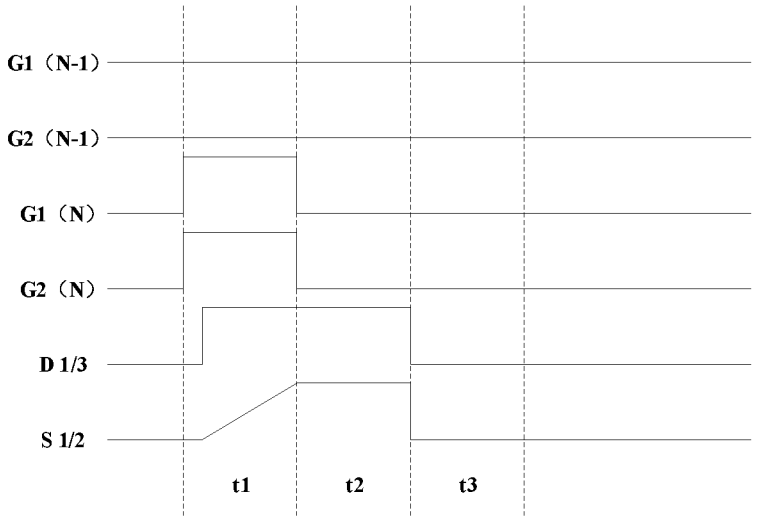
Figure 7:
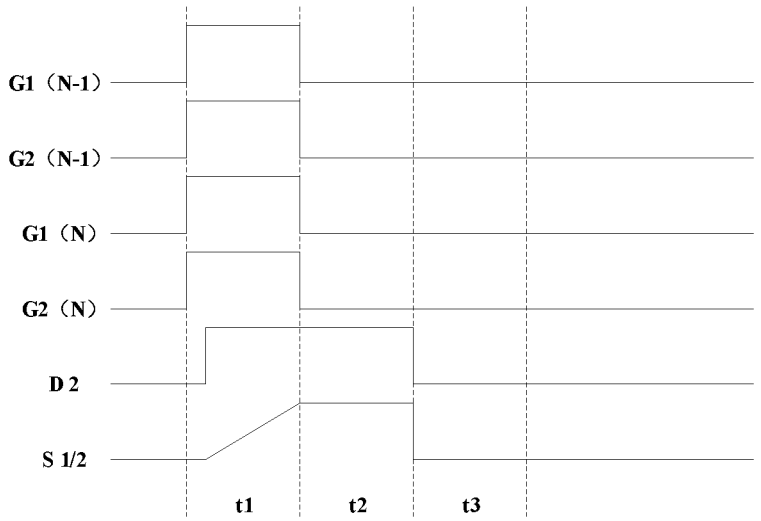

In the specific implementation, by taking a case of carrying out detection on sub pixels in a third row and a fourth row in FIG. 3 as an example, in combination of FIG. 5 to FIG. 7, the process of detecting sub-pixels in every two rows in the display panel is illustrated in detail. Moreover, detection is carried out according to a detection sequence of the sub-pixel a and the sub-pixel A, the sub-pixel c and the sub-pixel C, and the sub-pixel b and the sub-pixel B, in the specific implementation, the detection sequence may also be adjusted, and the detection sequence of the sub-pixels is not limited herein.

As shown in FIG. 5, each sub-pixel a and each sub-pixel A of sub-pixels in the third row are used as the to-be-compensated sub-pixels, the turned-on signals are input to the first gate line G1(N−1) and the second gate line G2(N−1), respectively, and the data voltages are input to the data lines D1 and D3 so as to control pixel circuits corresponding to each sub-pixel a and each sub-pixel A to charge each first detection line SEN1 and each second detection line SEN2; and the output voltages (i.e., output signals S1 and S2) of each first detection line SEN1 and each second detection line SEN2 are detected to determine the compensation voltages corresponding to each sub-pixel a and each sub-pixel A, so as to determine the data voltages required by each sub-pixel a and each sub-pixel A in the displaying process.

As shown in FIG. 6, each sub-pixel c and each sub-pixel C of sub-pixels in the third row are used as the to-be-compensated sub-pixels, the turned-on signals are input to the first gate line G1(N) and the second gate line G2(N), respectively, and the data voltages are input to the data lines D1 and D3 so as to control pixel circuits corresponding to each sub-pixel c and each sub-pixel C to charge each first detection line SEN1 and each second detection line SEN2; and the output voltages (i.e., output signals S1 and S2) of each first detection line SEN1 and each second detection line SEN2 are detected to determine the compensation voltages corresponding to each sub-pixel c and each sub-pixel C, so as to determine the data voltages required by each sub-pixel c and each sub-pixel C in the displaying process.

As shown in FIG. 7, each sub-pixel b and each sub-pixel B of sub-pixels in the third row are used as the to-be-compensated sub-pixels, the turned-on signals are input to the first gate lines G1(N) and G1(N−1) and the second gate lines G2(N) and G2(N−1), respectively, and the data voltage is input to the data line D2 so as to control pixel circuits corresponding to each sub-pixel b and each sub-pixel B to charge each first detection line SEN1 and each second detection line SEN2; and the output voltages (i.e., output signals S1 and S2) of each first detection line SEN1 and each second detection line SEN2 are detected to determine the compensation voltages corresponding to each sub-pixel b and each sub-pixel B, so as to determine the data voltages required by each sub-pixel b and each sub-pixel B in the displaying process.

Figure 8:
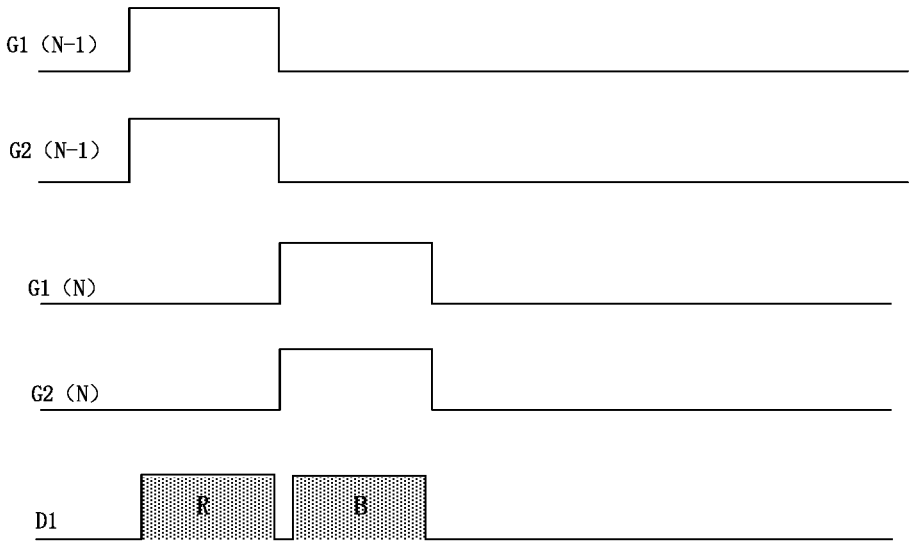
FIG. 8 is a timing diagram of display driving of two adjacent sub-pixels in different colors, which are coupled with the same data line.

In addition, in the practical application, in order to prevent signal crosstalk, when two adjacent sub-pixels in different colors, which are coupled with the same data line, are driven, low-level may be set between the data voltages corresponding to the two sub-pixels; and by taking a first red sub-pixel in the first row and a first blue sub-pixel in the second row in FIG. 3 as examples, according to a timing diagram as shown in FIG. 8, after the data line is controlled to input the data voltage to the red sub-pixel, a low voltage may be maintained for a period of time, and then the data voltage is input to the blue sub-pixel.

On the basis of the same inventive concept, an embodiment of the present disclosure further provides a display apparatus, including the above-mentioned display panel. The display apparatus may be applied to any product or part with a display function, such as a mobile phone, a tablet personal computer, a television, a display, a notebook computer, a digital photo frame, a navigator and the like. The principle of solving the problem of the display apparatus is similar to that of the display panel, and thus, implementation of the display apparatus can refer to implementation of the display panel, and will not be repeated herein.

According to the display panel and the driving method thereof and the display apparatus, as provided by the embodiments of the present disclosure, each first sub-pixel group corresponds to two compensation detection lines, wherein the sub-pixels in the first column are coupled with the first detection line, the sub-pixels in the third column are coupled with the second detection line, and the sub-pixels in the second column are alternatively coupled with the first detection line and the second detection line, so that in the detection compensation process, for each first sub-pixel group, two sub-pixels coupled with different compensation detection lines may be selected from the sub-pixels in two adjacent rows to be detected together, and thus, the sub-pixels in every two rows only need to be detected for three times, and the detection speed is increased to a great degree, thereby making display time relatively long and improving the display effect.

It is evident that one person skilled in the art can make various changes or modifications to the present disclosure without departure from the spirit and scope of the present disclosure. Thus, if these changes and modifications to the present disclosure are within the scope of the claims of the present disclosure and equivalent technologies thereof, the present disclosure also intends to include all such changes and modifications within its scope.

What is claimed is:

1. A display panel, comprising:

a plurality of sub-pixels in an array, wherein sub-pixels in every three columns of the array serve as one of first sub-pixel groups;

a plurality of data lines, wherein a respective one of the plurality of data lines is coupled with sub-pixels in a respective one column of the array; and a plurality of compensation detection lines, wherein each of the first sub-pixel groups corresponds to two of the compensation detection lines, and the two of the compensation detection lines comprise a first detection line and a second detection line; and in each of the first sub-pixel groups, sub-pixels in a first column of the every three columns are coupled with the first detection line, sub-pixels in a third column of the every three columns are coupled with the second detection line, and sub-pixels in a second column of the every three columns are alternatively coupled with the first detection line and the second detection line.

2. The display panel according to claim 1, wherein two adjacent sub-pixels in a column of the array are staggered in a column direction by X sub-pixels; and $0<X<1$.

3. The display panel according to claim 1, wherein sub-pixels in each column of the array comprise sub-pixels in two colors, and the sub-pixels in two colors are alternatively arranged; and sub-pixels in each row of the array comprise sub-pixels in three colors, and sub-pixels in each color of the three colors are periodically and repeatedly arranged in the row.

4. The display panel according to claim 1, further comprising: a plurality of first gate lines and a plurality of second gate lines;

wherein each of the plurality of sub-pixels comprises a switching transistor and a detection transistor, an input terminal of the switching transistor is coupled with the data line, and an output terminal of the detection transistor is coupled with one of the plurality of compensation detection line; and for sub-pixels in each row of the array, a control terminal of the detection transistor in each of the sub-pixels in the row of the array is coupled with one of the plurality of first gate lines, and a control terminal of the switching transistor in each of the sub-pixels in the row of the array is coupled with one of the plurality of second gate line.

5. The display panel according to claim 4, wherein each of the plurality of sub-pixels further comprises a drive transistor and a storage capacitor;

an input terminal of the drive transistor is coupled with a high-voltage power signal line, an output terminal of the drive transistor is coupled with an output terminal of a light emitting device and an input terminal of the detection transistor, and a control terminal of the drive transistor is coupled with an output terminal of the switching transistor; and the storage capacitor is coupled between the control terminal of and the output terminal of the drive transistor.

6. The display panel according to claim 4, wherein the first gate line and the second gate line which are coupled with the sub-pixels in a same row of the array are positioned in a same row gap.

7. The display panel according to claim 6, wherein sub-pixels in every two rows of the array serve as one second pixel group; and the first gate line and the second gate line which correspond to a same second pixel group are both positioned in a row gap in the second pixel group.

8. A driving method of the display panel according to claim 1, comprising:

in a compensation time period, for each first sub-pixel group, when compensation detection is carried out each time, selecting, from sub-pixels in two adjacent rows of the array, one sub-pixel coupled with the first detection line and one sub-pixel coupled with the second detection line as to-be-compensated sub-pixels;

controlling each of the to-be-compensated sub-pixels to charge the compensation detection line coupled with each of the to-be-compensated sub-pixels; and detecting an output voltage of the compensation detection line coupled with each of the to-be-compensated sub-pixels, and determining a compensation voltage of the to-be-compensated sub-pixels according to the output voltage.

9. The driving method according to claim 8, wherein when compensation detection is carried out at a time, the two to-be-compensated sub-pixels selected from sub-pixels in two adjacent rows of the array are positioned on a same row.

10. The driving method according to claim 9, wherein the controlling each of the to-be-compensated sub-pixels to charge the compensation detection line coupled with each of the to-be-compensated sub-pixels specifically comprises:

inputting synchronously turned-on signals to respective first gate lines and respective second gate lines which are coupled with to-be-compensated sub-pixels in respective row, respectively, and inputting data voltages to the plurality of data lines coupled with the to-be-compensated sub-pixels.

11. The driving method according to claim 8, wherein when compensation detection is carried out at a time, the two to-be-compensated sub-pixels selected from sub-pixels in two adjacent rows of the array are positioned on a same column.

12. The driving method according to claim 11, wherein the controlling each of the to-be-compensated sub-pixels to charge the compensation detection line coupled with each of the to-be-compensated sub-pixels specifically comprises:

inputting synchronously turned-on signals to respective first gate lines and respective second gate lines which are coupled with to-be-compensated sub-pixels in respective row, respectively, and inputting data voltages to the plurality of data lines coupled with the to-be-compensated sub-pixels.

13. The driving method according to claim 8, wherein the controlling each of the to-be-compensated sub-pixels to charge the compensation detection line coupled with each of the to-be-compensated sub-pixels specifically comprises:

inputting synchronously turned-on signals to respective first gate lines and respective second gate lines which are coupled with to-be-compensated sub-pixels in respective row, respectively, and inputting data voltages to the plurality of data lines coupled with the to-be-compensated sub-pixels.

14. The driving method according to claim 13, wherein when data voltages of different sub-pixels are sequentially input to a same data line, setting low-level between the data voltages.

15. A display apparatus, comprising: the display panel according to claim 1.

* * * * *